US008430282B2

(12) United States Patent
Sellers

(10) Patent No.: US 8,430,282 B2
(45) Date of Patent: Apr. 30, 2013

(54) DECORATIVE BOW CONSTRUCTION APPARATUS AND METHOD

(76) Inventor: Regina Sellers, Houma, LA (US)

( * ) Notice: Subject to any disclaimer, the term of this patent is extended or adjusted under 35 U.S.C. 154(b) by 198 days.

(21) Appl. No.: 13/170,575

(22) Filed: Jun. 28, 2011

(65) Prior Publication Data

US 2012/0012621 A1 Jan. 19, 2012

(51) Int. Cl.
*A41H 43/00* (2006.01)
*A41H 15/00* (2006.01)

(52) U.S. Cl.
USPC ..... 223/46; 428/5

(58) Field of Classification Search ..... 223/44–46; 428/4, 5; 28/147–150
See application file for complete search history.

(56) References Cited

U.S. PATENT DOCUMENTS 2,666,249 A * 1/1954 Ruiz et al. ..... 28/150
2,763,080 A * 9/1956 Welch ..... 428/5
3,044,670 A * 7/1962 Barefoot ..... 223/46
3,291,352 A * 12/1966 Raimonds ..... 223/46
3,501,070 A * 3/1970 Shattuck ..... 223/46
4,454,968 A * 6/1984 StLawrence ..... 223/46
4,629,100 A 12/1986 Owens
5,356,056 A * 10/1994 Teuten ..... 223/46
5,411,188 A 5/1995 Teuten
5,499,759 A 3/1996 Richards
6,000,586 A 12/1999 Cavender
6,131,778 A 10/2000 Etzion
7,857,175 B2 * 12/2010 Schorr ..... 223/46
2003/0197041 A1 10/2003 West, Sr.
2008/0000934 A1 1/2008 Schorr
2009/0294490 A1 12/2009 Gustin

* cited by examiner

*Primary Examiner* — Ismael Izaguirre
(74) *Attorney, Agent, or Firm* — Kenneth L. Green

(57) ABSTRACT

An apparatus and method for constructing bows includes a horizontal layout board holding vertical dowels and a method for winding ribbon around the dowels to form a bow. A center dowel, left dowels, and right dowels are positioned at progressively increasing spacing from a base dowel. The spacing of the dowels on the layout board facilitates efficient use of material. The apparatus facilitates construction of bows without extensive training or experience.

15 Claims, 6 Drawing Sheets

DECORATIVE BOW CONSTRUCTION APPARATUS AND METHOD

BACKGROUND OF THE INVENTION

The present invention relates to constructing bows and in particular to a board with pegs positioned to facilitate constructing a decorative bow.

Known methods for constructing decorative bows comprise manual steps of measuring and forming each loop of the bow. The partially formed bows are held by the bow maker and each new loop is manually measured using a ruler or measuring tape. These methods are fatiguing, time consuming, and generally unpleasant. An inexperienced bow maker often fails to accurately measure ribbon used to add loops as the bow is formed, and an unattractive decorative bow results.

Additionally, the decorative bows are often constructed from one or more ribbon (often three ribbons), which are purchased on thirty foot (i.e., ten yard) spools. One very popular bow requires 10 feet (i.e., three yards and one foot) of ribbon. Because all of the ribbon is used to construct three bows, the ribbon must be used very efficiently to obtain three complete bows from one spool. Known methods require substantial training and bow makers may still often fail to obtain satisfactory results.

BRIEF SUMMARY OF THE INVENTION

The present invention addresses the above and other needs by providing an apparatus and method for constructing bows which includes a horizontal layout board holding vertical dowels and a method for winding ribbon around the dowels to form a bow. A center dowel, left dowels, and right dowels are positioned at progressively increasing spacing from a base dowel. The spacing of the dowels on the layout board facilitates efficient use of material. The apparatus facilitates construction of bows without extensive training or experience.

In accordance with one aspect of the invention, there is provided a layout board including dowels facilitating the construction of decorative bows. The dowels are positioned on the layout board using dowel holes. The dowel holes include a base dowel hole, a center dowel hole, and right and left dowel holes spaced progressively farther from the base dowel hole. Loops of ribbon are then formed by winding the ribbon around the dowels to obtain the desired decorative bow.

In accordance with another aspect of the invention, there is provided a method for using the layout board and dowels to construct a decorative bow. The method includes the steps of: tying one end of a ribbon to a base dowel attached to a layout board using a tie; winding the ribbon on edge in a counter-clockwise direction around a center dowel attached to the layout board directly above the base dowel to form a first loop; pulling the ribbon snugly; continue the counter-clockwise winding on edge back around the base dowel; winding the ribbon clockwise around a first right dowel attached to the layout board to form a second loop; pulling the ribbon snugly; continue the clockwise winding back around the base dowel; winding the ribbon counter-clockwise around a first left dowel attached to the layout board to form a third loop; pulling the ribbon snugly; continue the counter-clockwise winding back around the base dowel; repeating the steps of clockwise winding around additional right dowels attached to the layout board and counter-clockwise winding around additional left dowels attached to the layout board, until all of the remaining loops are formed; releasing the tie from the base dowel; tying the tie around all of the ribbon loops; lifting the flat bow from the layout board and dowels; and spreading the loops to form individual bows.

In accordance with yet another aspect of the invention, there is provided a method for using the layout board and dowels to construct a decorative bow using ribbon having one decorative side and one plain side. The method includes twisting the ribbon 180 degrees as the ribbon is wound around the base dowel to keep the decorative side on outer faces of the loops.

In accordance with still another aspect of the invention, there is provided a method for drawing ribbon from one or more spools as the bow is constructed. A spool holder is positioned next to the layout board and one or more ribbon are drawn from spools. The ribbon is wound around the dowels to form loops of the bows, and the ribbon is twisted 180 degrees each time the ribbon is wound around the base dowel, by rotating the decorative side of the ribbon facing away from the base dowel 90 degrees to face down and continuing to rotate the ribbon an additional 90 degrees so that the preferred pattern is facing the base dowel. An additional benefit of such twisting is a problem of twisting in the ribbon between the spools and layout board is removed.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1A:
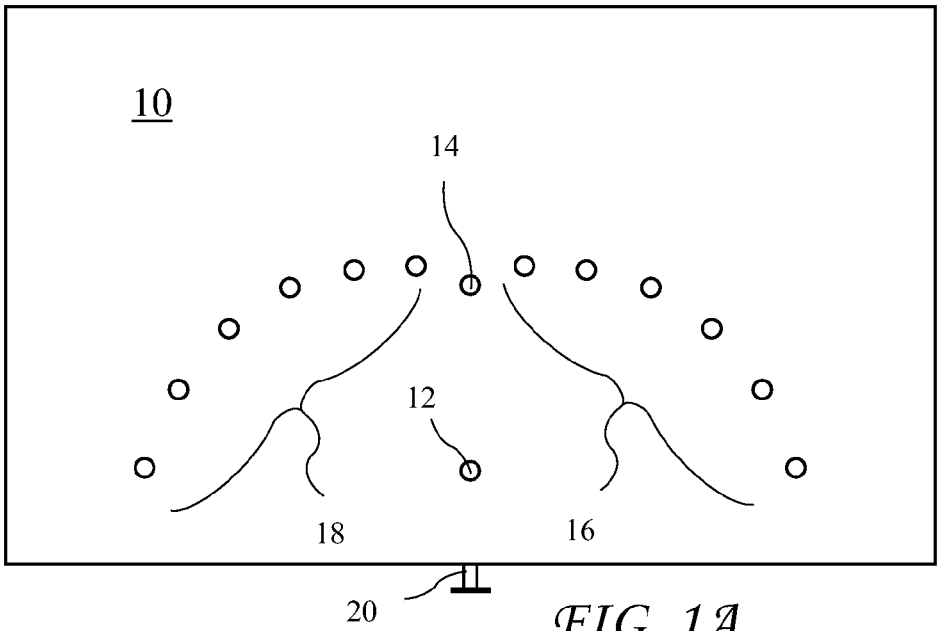
FIG. 1A is a top view of a layout board and dowel positions for making bows according to the present invention.
Figure 1B:
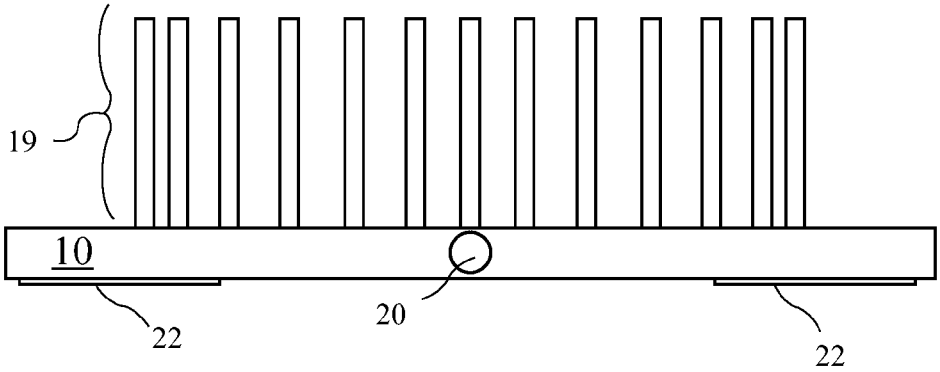
FIG. 1B is a front view of the layout board and dowels for making the bows according to the present invention.

A top view of a layout board 10 and dowel positions for making bows according to the present invention is shown in FIG. 1A and a front view of the layout board 10 and dowel 19 for making the bows is shown in FIG. 1B. A base dowel position 12 resides laterally centered and near a forward edge of the layout board 10. A center dowel position 14 resides above the base dowel position 12 and also laterally centered on the board. Right dowel positions 16 reside to the right of the center dowel position 16 in an arc reaching from near the center dowel position 14 towards a right front corner of the layout board 10. Left dowel positions 18 reside to the left of the center dowel position 16 in an arc reaching from near the center dowel position 14 towards a left front corner of the layout board 10. A nail, screw, or similar attachment point 20 is attached to a front edge of the layout board 10 approximately laterally centered. Non-skid pads 22 may be provided on the bottom of the board 10 to reduce slipping. The dowels are hereafter referred to base, center, right, and left dowels corresponding to their positions in the board 10.

A preferred layout board 10 approximate size is 20.25 inches wide, 8.5 inches deep, and 0.75 inches thick. Preferred pads 22 may be four 2.5 inches by 2.5 inches 0.035 inch thick vinyl/nitrite blend having four mills of acrylic adhesive at each corner of the layout board 10.

An important feature of the layout board 10 and dowel positions is the separation of the center, right, and left dowel positions from the base dowel. As described below, a length of ribbon 30 is wound around the dowels 19 in a specific order and direction to provide loops of the desired length to form an esthetically pleasing bow and to efficiently use the length of ribbon. A typical bow may be made from ten feet of ribbon, which is a convenient length because ribbon commonly comes in 30 foot rolls. Because the length of ribbon is exactly three times the total length of ribbon on a typical spool, the length of ribbon cannot be cut to excess length, and the method for making the bows must not significantly vary in the amount of ribbon used. In order to obtain the desired loop sizes to construct a preferred bow, the center dowel 14 is positioned 4.25 inches from the base dowel 12. The right and left dowel positions 16 and 18 are progressively positioned ½ inch farther from the base dowel position 12 (i.e., 4.75, 5.25, 5.75 and so on). The resulting bow is completed using the selected length of ribbon and produces the desired appearance. Other bows require different lengths of ribbon, and the present invention is also advantageous when ever using a precise length of ribbon has value.

The layout board 10 is described in FIGS. 1A and 1B with a single set of dowel positions for constructing a single size bow. In generally, the layout board 10 will include two or more sets of dowel positions for constructing two or more sizes of bows. For example, five sets of center, right and left dowel positions may be provided for constructing five sizes of bows. Each set of dowel positions continues the relationship of progressive positioning about ½ inch farther from the base dowel 12, starting from the center dowel, to use the desired length of ribbon and obtain the desired appearance. The center and right and left dowels thus form a pattern resembling the top of a heart, with the base dowel residing inside the heart.

For the smallest size bow, the dowel positions may be defined by holes about ¼ inches in diameter and about ½ inches deep, and for larger size bows, the dowel positions may be defined by holes about ⅜ inches in diameter and about ½ inches deep. The larger dowels are preferably about ⅜ inches in diameter and about 3½ inches long and the smaller dowels are preferably about ¼ inches in diameter and about 2½ inches long.

Figure 2:
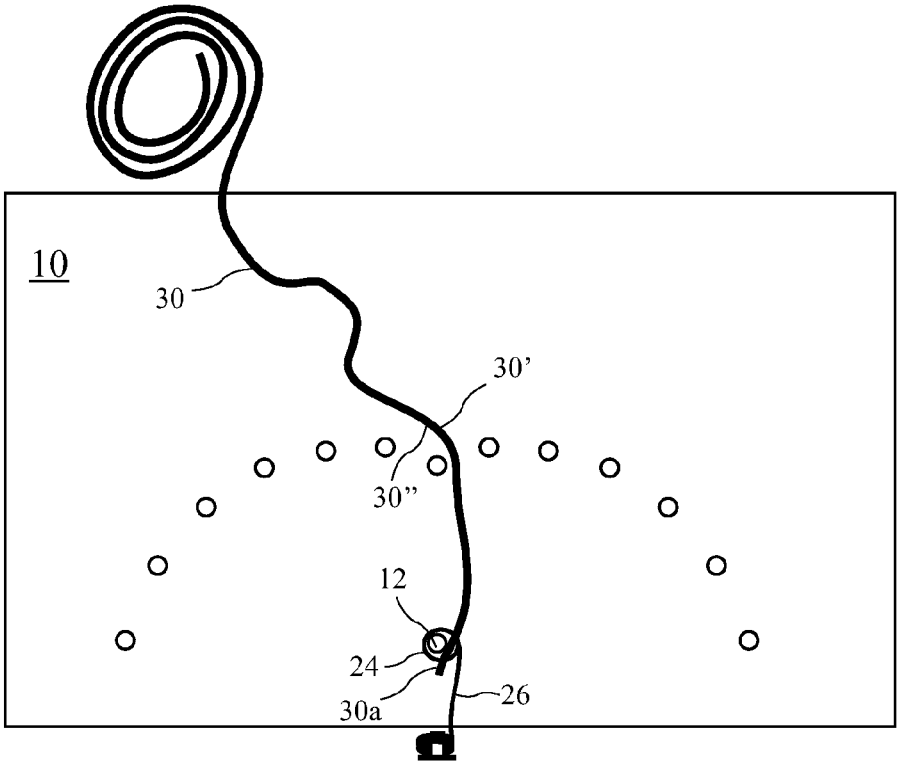
FIG. 2 shows a first bow making step of attaching an end of a length of ribbon to a base dowel according to the present invention.

A first bow making step of attaching an end 30*a* of a length of ribbon 30 to the base dowel using a wire 26 according to the present invention is shown in FIG. 2. One end of the wire 26 is wound around the base dowel 12 and extra wire 26 is wound around the attachment point 20 for later use. The length of ribbon 30 forming the loops preferably remains on edge during construction of the bow. The ribbon 30 typically has a decorative side 30' and a plain side 30".

Figure 3:
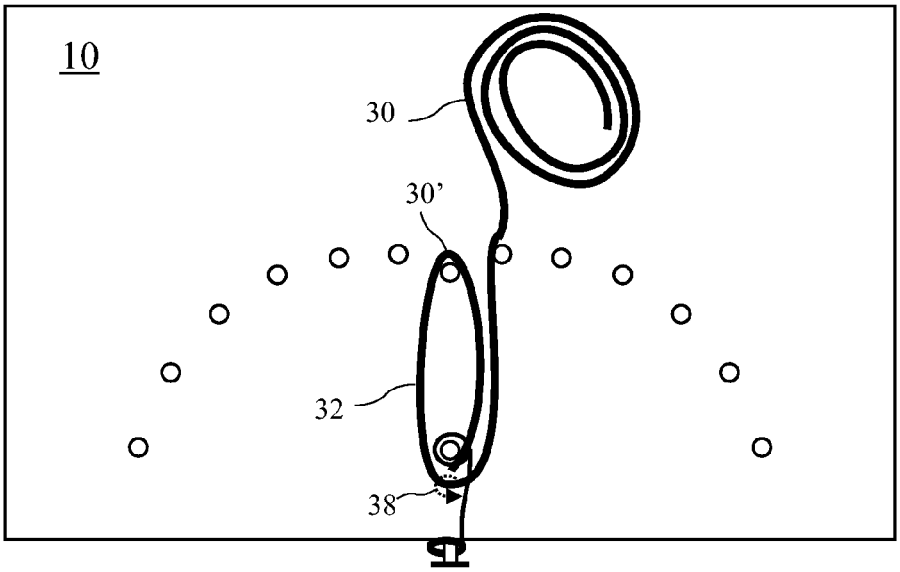
FIG. 3 shows a second bow making step of winding the ribbon in a counter-clockwise direction around a center dowel attached to the layout board directly above the base dowel and continue the counter-clockwise winding back around the base dowel according to the present invention.

A second bow making step of winding the length of ribbon 30 in a counter-clockwise direction around the center dowel 14 directly above the base dowel 12 (see FIG. 1A), and continue the counter-clockwise winding back around the base dowel according to the present invention is shown in FIG. 3. The second step forms the first loop 32 and the remaining loose portion of the length of ribbon 30 is firmly pulled away from the base dowel and the ribbon 30 is twisted 38 180 degrees as the ribbon 30 is wound around the base dowel 12. Twisting 38 the ribbon 180 degrees reverses the ribbon 30 to place the decorative side 30' of the ribbon 30 on the outside of a second loop 34 (see FIG. 4).

Figure 4:
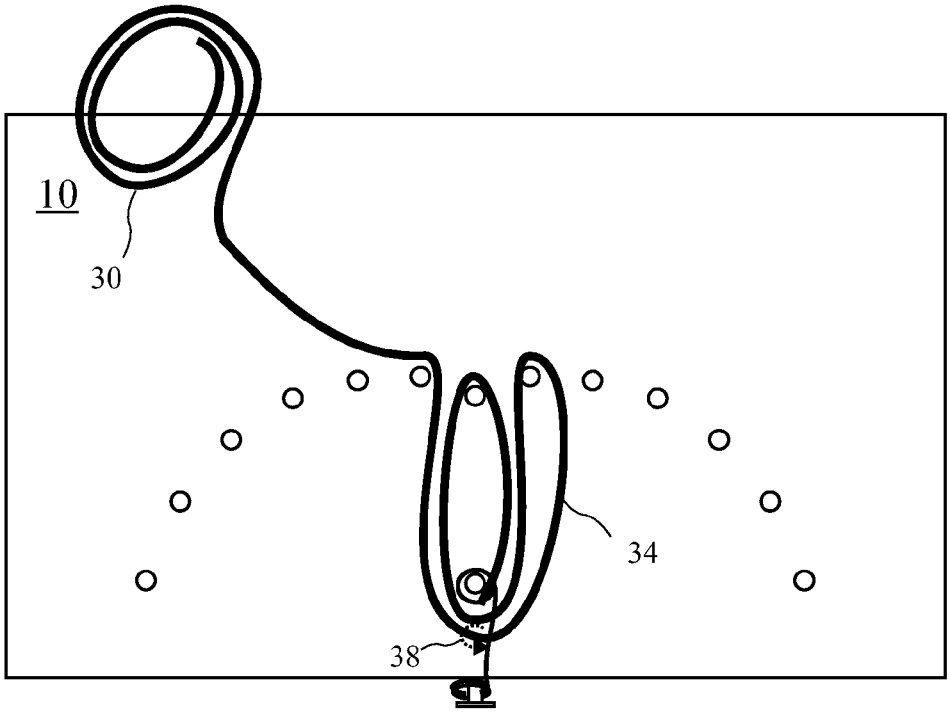
FIG. 4 shows a third bow making step of winding the ribbon clockwise around a first right dowel attached to the layout board and continuing the clockwise winding back around the base dowel according to the present invention.

A third bow making step of winding the length of ribbon 30 clockwise around a first right dowel 16 and continuing the clockwise winding back around the base dowel 12, and twisting 38 the ribbon 180 degrees as the ribbon 30 is wound around the base dowel 12, is shown in FIG. 4 forming the second loop 34.

Figure 5:
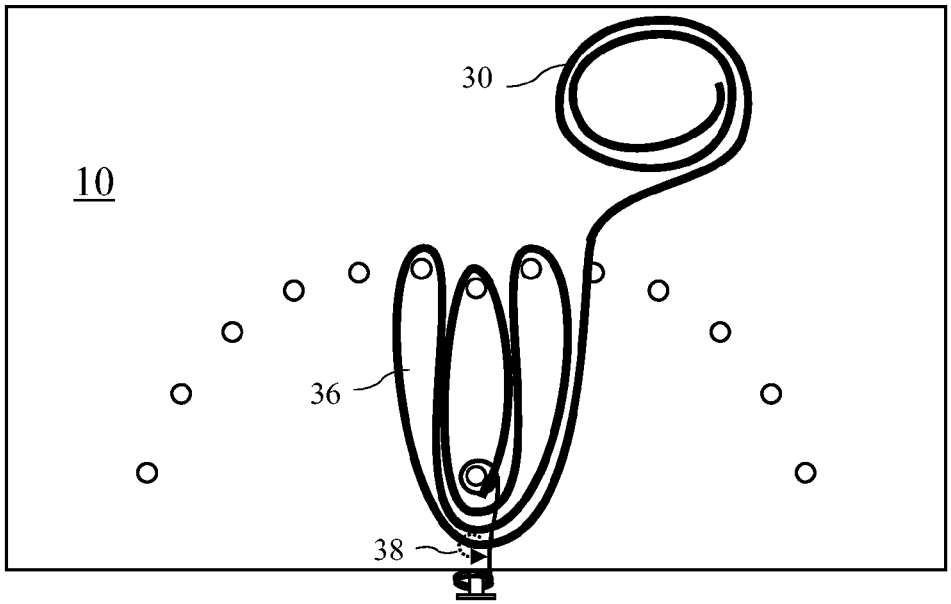
FIG. 5 shows a fourth bow making step of winding the ribbon counter-clockwise around a first left dowel attached to the layout board and continue the counter-clockwise winding back around the base dowel.

A fourth bow making step of winding the length of ribbon 30 counter-clockwise around a first left dowel 18 and continuing the counter-clockwise winding back around the base dowel 12, and twisting 38 the ribbon 180 degrees as the ribbon 30 is wound around the base dowel 12, to form a third loop 36 is shown in FIG. 5.

Figure 6:
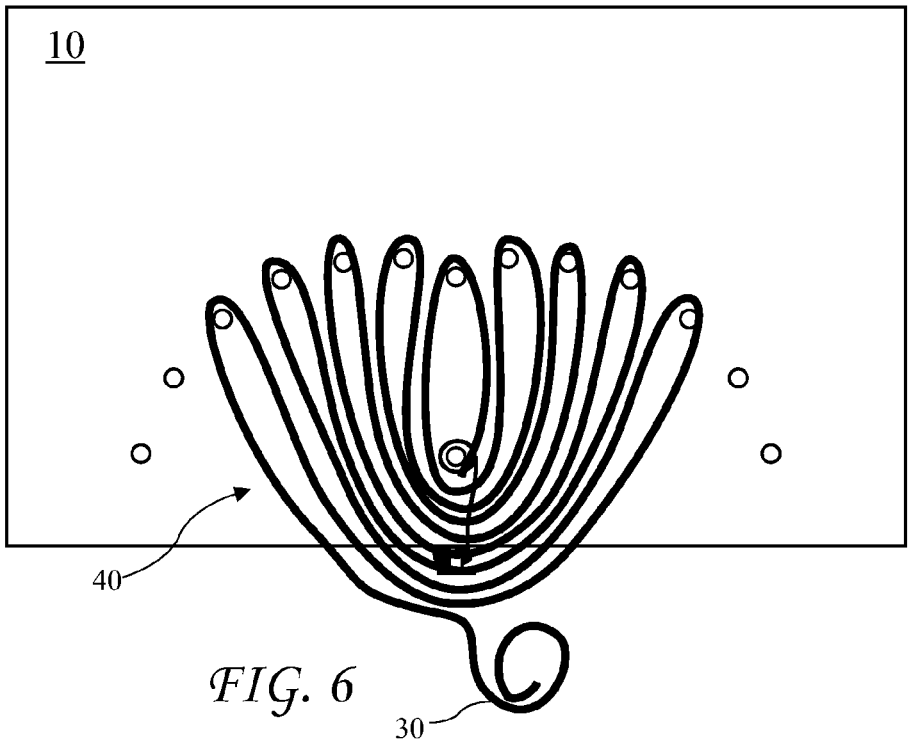
FIG. 6 shows the results of repeating the clockwise winding around additional right dowels attached to the layout board and counter-clockwise winding around additional left dowels attached to the layout board until all of the remaining loops are formed leaving some length of ribbon trailing off below the base dowel according to the present invention.

The clockwise winding around additional right dowels and counter-clockwise winding around additional left dowels, and twisting the ribon 180 degrees as the ribbon is wound around the base dowel, is continued until all of the desired loops are formed is shown in FIG. 6 according to the present invention. Some of the length of ribbon 30 may be left trailing off below the base dowel to form a tail for the bow.

Figure 7:
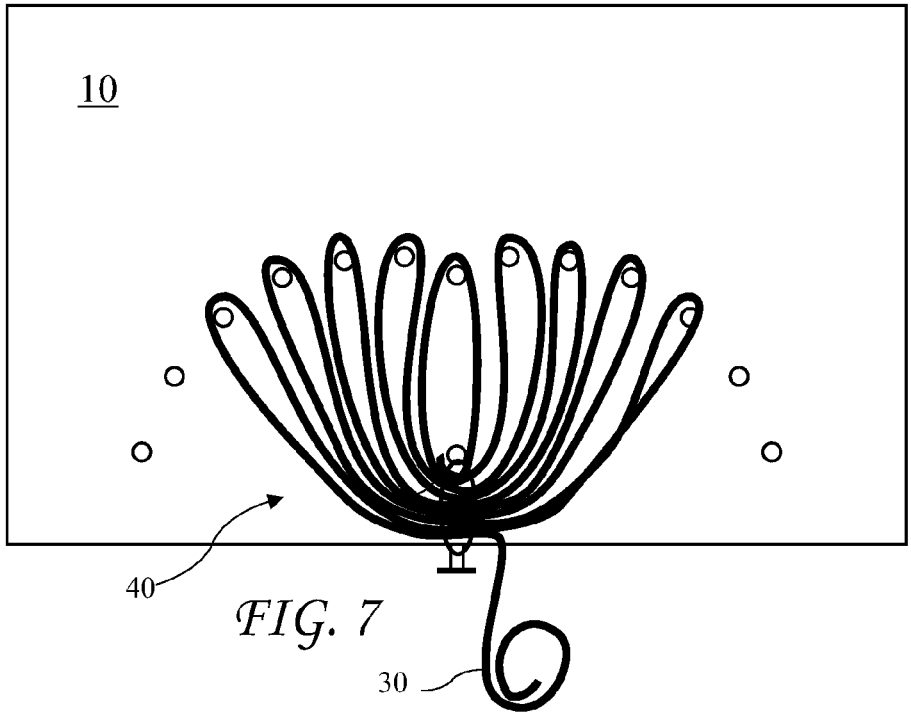
FIG. 7 shows tying the tie around all of the ribbon loops according to the present invention.

The extra wire wrapped around the attachment point 20 is now released and tied around all of the ribbon loops as shown in FIG. 7.

Figure 8:
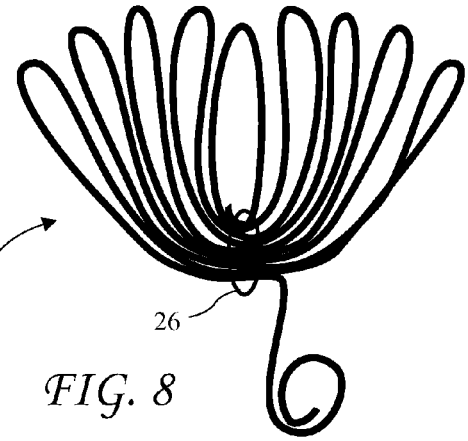
FIG. 8 shows releasing the tie and bow from the base dowel and lifting the flat bow from the layout board and dowels according to the present invention.

The flat bow may now be lifted from the layout board 10 and dowels 19 as shown in FIG. 8.

Figure 9:
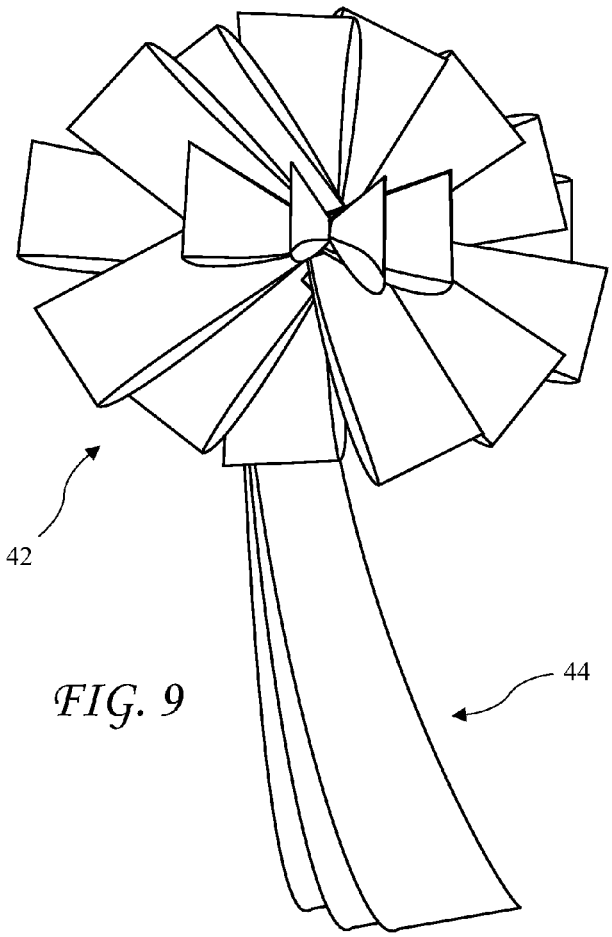
FIG. 9 shows spreading the loops to form the bows according to the present invention.

The result of spreading the loops to form the bow is shown in FIG. 9. The bow is generally formed from three laid together ribbons, and each ribbon may be spread apart to form a fully circular bow 42 having loops of all three ribbons clearly visible. The individual loops may be further spread outward to add depth to the bow. Any remaining length of ribbon trails below the bow forming a tail 44.

Figure 10:
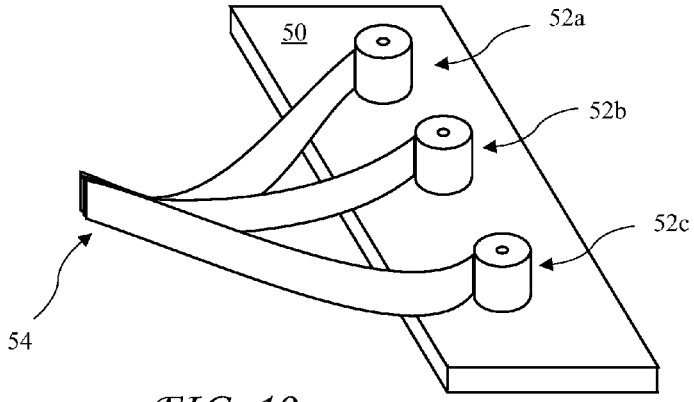
FIG. 10 shows a spool holder holding three ribbon spools used to combine three lengths of ribbon for constructing a bow according to the present invention.
Figure 11:
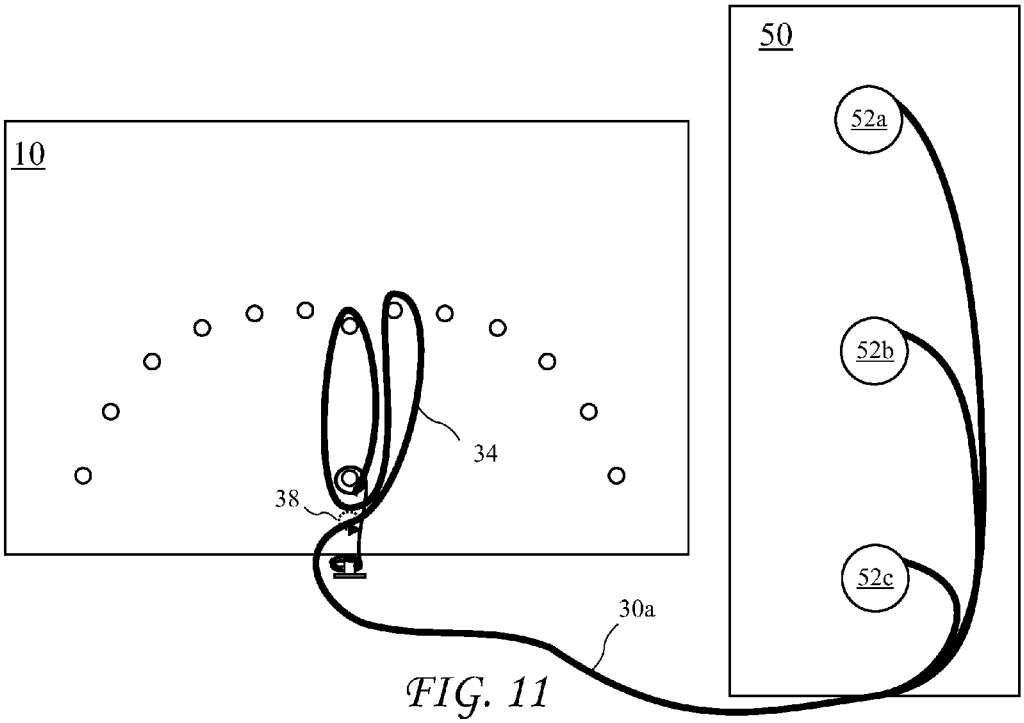
FIG. 11 shows the ribbon being drawn from spools during construction of the bow.

A spool holder 50 holding three ribbon spools 52*a*, 52*b*, and 52*c* is shown in FIG. 10. The spool holder 50 is used to combine three lengths of ribbon into laid together ribbon 54 which may be cut into a length of laid together ribbon for constructing the bow according to the present invention.

The ribbon 30 is shown being drawn from spools 52*a*, 52*b*, and 52*c* during construction of the bow 42, as distinguished from initially cutting a length of ribbon 30. Winding the ribbon 30 around the dowels 12, 14, 16, and 18 to form each loop 34 of the bow 42 also results in twisting the length of ribbon 30*a* between the spools 52*a*, 52*b*, and 52*c* and the layout board 10. Such twisting may be addressed by proper twisting of the ribbon 30 when the ribbon 30 is would around the base dowel 12. The ribbon 30 is thus preferably twisted 38 to expose the decorative side of the ribbon for the next loop, and advantageously to also untwist the length of ribbon 30*a* between the layout board 10 and the spools 52*a*, 52*b*, and 52*c*, each time the ribbon 30 is wound around the base dowel 12. The twisting 38 may comprise rotating the side of the ribbon 30 facing away from the base dowel 12 to face down and continuing to rotate the ribbon 30 an additional 90 degrees so that the decorative side 30' of the ribbon 30 is facing the base dowel 12 and is on the outside to the next loop.

The method of the invention of described above starting with counter-clockwise winding of bow material, but the method may be equivalently performed by reversing the winding of each step.

While the invention herein disclosed has been described by means of specific embodiments and applications thereof, numerous modifications and variations could be made thereto by those skilled in the art without departing from the scope of the invention set forth in the claims.

I claim:

1. A method for forming a bow comprising the steps of:

tying one end of a ribbon to a base dowel attached to a layout board using a tie;

winding the ribbon on edge in a counter-clockwise direction around a center dowel attached to the layout board directly above the base dowel to form a first loop;

pulling the ribbon snugly;

continue the counter-clockwise winding on edge back around the base dowel;

winding the ribbon clockwise around a first right dowel attached to the layout board to form a second loop;

pulling the ribbon snugly;

continue the clockwise winding back around the base dowel;

winding the ribbon counter-clockwise around a first left dowel attached to the layout board to form a third loop;

pulling the ribbon snugly;

continue the counter-clockwise winding back around the base dowel;

repeating the steps of clockwise winding around additional right dowels attached to the layout board and counter-clockwise winding around additional left dowels attached to the layout board, until all of the remaining loops are formed;

releasing the tie from the base dowel;

tying the tie around all of the ribbon loops;

lifting the flat bow from the layout board and dowels; and spreading the loops to form individual bows.

2. The method of claim 1, wherein the ribbon is a length of ribbon cut from at least one spool.

3. The method of claim 2, further including after forming all of the loops. leaving some length of ribbon trailing off below the base dowel to form a tail of the bow.

4. The method of claim 2, wherein:

cutting a length of ribbon comprises cutting three lengths of three ribbons laid together; and winding the ribbon comprises winding the three laid together ribbons.

5. The method of claim 4, further including, after lifting the flat bow from the layout board and dowels, separating the three ribbons to add volume to the bow.

6. The method of claim 5, wherein separating the three ribbons to add volume to the bow includes separating the three ribbons to create a full circular bow.

7. The method of claim 1, wherein tying one end of the length of ribbon to a base dowel comprises tying one end of the length of ribbon to a base dowel using wire.

8. The method of claim 7, wherein tying one end of the length of ribbon to a base dowel using wire further includes leaving extra wire wrapped around a nail head proximal to the base dowel for later use.

9. The method of claim 8, further including, after lifting the flat bow from the layout board and dowels, tying the extra wire around all of the loops.

10. The method of claim 1, wherein repeating the clockwise winding around additional right dowels attached to the layout board and counter-clockwise winding around additional left dowels attached to the layout board comprises repeating the winding around additional right and left dowel spaced progressively an additional ½ inch from the base dowel to form progressively longer loops.

11. The method of claim 1, further including twisting the ribbon 180 degrees as the ribbon winds around the base dowel to keep a decorative side of the ribbon on an outside of each loop.

12. The method of claim 11, wherein twisting the ribbon 180 degrees comprises twisting the ribbon 90 degrees so that the decorative side of the ribbon, facing away from the base dowel, faces down, and continuing to rotate the ribbon an additional 90 degrees so that the decorative side of the ribbon is facing the base dowel and is on the outside of the next loop.

13. The method of claim 1, wherein the ribbon is drawn from a spool as the bow is constructed and further including:

twisting the ribbon 180 degrees as the ribbon winds around the base dowel, in a direction to remove a twist in the ribbon between the spool and the layout board, to keep a decorative side of the ribbon on an outside of each loop; and after tying the tie around all of the ribbon loops, cutting the ribbon.

14. A method for forming a bow comprising the steps of:

cutting lengths of ribbon from three spools;

overlaying the three ribbons with decorative sides up;

tying one end of a ribbons to a base dowel attached to a layout board using a tie;

winding the ribbons on edge in a counter-clockwise direction, with the decorative sides out, around a center dowel attached to the layout board directly above the base dowel to form a first loop;

pulling the ribbons snugly;

continue the counter-clockwise winding on edge back around the base dowel and twisting the ribbons 180 degrees as the ribbons winds around the base dowel to keep the decorative sides on the outside of a second loop;

winding the ribbons clockwise around a first right dowel attached to the layout board, with the decorative sides out, to form the second loop;

pulling the ribbon snugly;

continue the clockwise winding back around the base dowel and twisting the ribbon 180 degrees as the ribbon winds around the base dowel to keep the decorative sides on the outside of the third loop;

winding the ribbon counter-clockwise around a first left dowel attached to the layout board to form the third loop;

pulling the ribbon snugly;

continue the counter-clockwise winding back around the base dowel;

twisting the ribbon 180 degrees as the ribbon winds around the base dowel to keep the decorative sides on the outside of the next loop;

repeating the steps of clockwise winding around additional right dowels attached to the layout board and counter-clockwise winding around additional left dowels attached to the layout board, and twisting the ribbon 180 degrees as the ribbon winds around the base dowel, until all of the remaining loops are formed;

releasing the tie from the base dowel;

tying the tie around all of the ribbon loops;

lifting the flat bow from the layout board and dowels; and spreading the loops to form individual bows.

15. A method for forming a bow comprising the steps of:

drawing ribbons from three spools;

overlaying the three ribbons with decorative sides up;

tying ends of the ribbons to a base dowel attached to a layout board using a tie;

winding the ribbon on edge in a counter-clockwise direction around a center dowel attached to the layout board directly above the base dowel, with the decorative sides out, to form a first loop;

pulling the ribbon snugly;

continue the counter-clockwise winding on edge back around the base dowel and twisting the ribbon 180 degrees as the ribbons wind around the base dowel to keep the decorative sides on the outside of a second loop, the twisting in a direction to remove a twist in the ribbons between the spools and the layout board;

winding the ribbons clockwise around a first right dowel attached to the layout board to form the second loop;

pulling the ribbon snugly;

continue the clockwise winding back around the base dowel and twisting the ribbon 180 degrees as the ribbons wind around the base dowel to keep decorative side on the outside of the third loop, the twisting in the direction to remove the twist in the ribbons between the spools and the layout board;

winding the ribbon counter-clockwise around a first left dowel attached to the layout board to form the third loop;

pulling the ribbon snugly;

continue the counter-clockwise winding back around the base dowel;

twisting the ribbon 180 degrees as the ribbon winds around the base dowel to keep the decorative side on the outside of the next loop, the twisting in the direction to remove the twist in the ribbons between the spools and the layout board;

repeating the steps of clockwise winding around additional right dowels attached to the layout board and counter-clockwise winding around additional left dowels attached to the layout board, and twisting the ribbon 180 degrees as the ribbon winds around the base dowel, until all of the remaining loops are formed;

releasing the tie from the base dowel;

tying the tie around all of the ribbon loops;

lifting the flat bow from the layout board and dowels; and spreading the loops to form individual bows.

* * * * *